US005557306A

United States Patent [19]

Fukushima et al.

[11] Patent Number: 5,557,306

[45] Date of Patent: Sep. 17, 1996

[54] INK JET PRINTER WITH A CLEANING APPARATUS FOR REMOVING HARDENED INK FROM A NOZZLE PLATE OF A PRINT HEAD

[75] Inventors: Tohru Fukushima; Kenichi Kanbayashi; Eiji Kumai, all of Nagano, Japan

[73] Assignee: Seiko Epson Corporation, Tokyo, Japan

[21] Appl. No.: 167,073

[22] Filed: Dec. 15, 1993

[30] Foreign Application Priority Data

| | | | |
|---|---|---|---|
| Dec. 16, 1992 | [JP] | Japan | 4-336382 |
| Dec. 16, 1992 | [JP] | Japan | 4-336383 |
| May 6, 1993 | [JP] | Japan | 5-105580 |
| Nov. 19, 1993 | [JP] | Japan | 5-314134 |

[51] Int. Cl.[6] ..... B41J 2/165

[52] U.S. Cl. ..... 347/33

[58] Field of Search ..... 347/12, 13, 22, 347/23, 30, 33, 35, 40, 42, 85

[56] References Cited

U.S. PATENT DOCUMENTS

| | | | |
|---|---|---|---|
| 4,245,224 | 1/1981 | Isayama et al. | 347/35 |
| 4,340,897 | 7/1982 | Miller | 347/33 |
| 4,369,456 | 1/1983 | Cruz-Uribe et al. | 347/33 |
| 4,538,156 | 8/1985 | Durkee et al. | 347/22 |
| 4,951,066 | 8/1990 | Terasawa et al. | 347/33 |
| 5,040,000 | 8/1991 | Yokoi | 347/30 |
| 5,051,761 | 9/1991 | Fisher et al. | 347/30 |
| 5,250,962 | 10/1993 | Fisher et al. | 347/42 |

FOREIGN PATENT DOCUMENTS

| | | | |
|---|---|---|---|
| 2754630 | 6/1979 | Germany | 347/33 |
| 57-34969 | 2/1982 | Japan . | |
| 57-61574 | 4/1982 | Japan . | |
| 59-14963 | 1/1984 | Japan | 347/33 |
| 59-83664 | 5/1984 | Japan . | |
| 3099857 | 4/1991 | Japan . | |
| 3-99857 | 4/1991 | Japan | 347/33 |
| 3138157 | 6/1991 | Japan . | |
| 3-234626 | 10/1991 | Japan . | |
| 3258553 | 11/1991 | Japan . | |
| 4-16346 | 3/1992 | Japan . | |
| 4-80042 | 3/1992 | Japan . | |

*Primary Examiner*—Benjamin R. Fuller
*Assistant Examiner*—J. E. Barlow, Jr.
*Attorney, Agent, or Firm*—Sughrue, Mion, Zinn, Macpeak & Seas

[57] ABSTRACT

An ink jet printer in which hardened ink is readily and reliably removed from a nozzle plate. The ink jet printer includes a print head having a plural number of nozzle openings arrayed in the width direction of a recording paper, a head drive circuit for selectively outputting a first signal to cause a stream of ink droplets at a speed suitable for print and a second signal to cause ink to ooze through each nozzle opening, and a cleaning device with a rubbing function and which is usually positioned in a nonprinting region, but is movable in the longitudinal direction of the print head and with respect to a nozzle plate. In a cleaning mode, the cleaning device is operated while oozing ink from the nozzle openings. The hardened ink on the nozzle plate is dissolved by the oozing ink, and then removed therefrom through the rubbing and wiping operations of the cleaning device.

6 Claims, 8 Drawing Sheets

INK JET PRINTER WITH A CLEANING APPARATUS FOR REMOVING HARDENED INK FROM A NOZZLE PLATE OF A PRINT HEAD

BACKGROUND OF THE INVENTION

The present invention relates to an ink jet printer employing a cleaning technique for preventing the nozzles of a print head from being clogged, particularly in an ink jet printer of the type which uses high viscosity ink which hardens easily so as to improve print quality.

In a known ink jet printer, a print head includes a plural number of combinations each including a pressure generating chamber, a nozzle communicating with the pressure generating chamber, and a pressure generating element for varying the pressure within the pressure generating chamber. Print data signals drive the pressure generating elements to cause the discharge of a stream of ink droplets through the nozzles. An image is formed by the ink droplets discharged. This type of ink jet printer requires a smaller number of movable parts than a wire impact type printer. In this respect, the former is superior to the latter. Accordingly, the former printer has advantages of generation of less noise and reduction of the size and cost. However, the former is inferior to the latter for the reason that since ink in liquid form is used to print images on a print paper, some types of print paper blot easily, deteriorating print quality.

U.S. Pat. No. 4,538,156 succeeds in solving the blotting problem. As disclosed therein, an intermediate recording medium is provided in the form of a drum or a belt. Ink droplets from the print head are received by the intermediate recording medium. After ink solvent is volatilized to some extent, the ink image formed on the recording medium is transferred to the print paper. With this arrangement, the paper does not blot, regardless of its type, and good print quality is secured.

However, the printer of the above-mentioned patent must use ink of higher viscosity than a printer which projects streams of ink droplets toward the print paper directly in order to secure reliable transfer of the ink image from the intermediate recording medium to the print paper. Ink mist generated when ink is jetted through nozzle openings and ink spray bouncing from the intermediate recording medium collect on and adhere to the front face of the nozzle and form stiff films thereon. The thus-formed films can cause the jets of ink droplets to deviate from the intended course, leading to deterioration of print quality. To avoid this, the ink films must be removed at appropriate intervals of time.

The ink jet printer of the type in which ink is directly jetted toward the print paper suffers from the same problem. To cope with this, many types of cleaning devices have been proposed to remove ink adhering to the front face of the nozzle plates. However, in general these cleaning devices have been found to insufficiently remove the ink which contains compositions such as certain emulsions or sugars added thereto so as to increase the viscosity of ink and make it easy to form ink films of a type which attains improved print quality.

SUMMARY OF THE INVENTION

In light of the above problems of the prior art printers, it is an object of the present invention to provide an ink jet printer which is capable of reliably removing ink films adhering to the front face of a print head.

To achieve the above object, there is provided an ink jet printer comprising: a print head including a plural number of pressure generating chambers communicating with nozzle openings and pressure generating elements each for varying a pressure to cause the ejection of a stream of ink droplets from the pressure chamber through the nozzle openings, the pressure generating chambers and the pressure generating elements being arrayed in the width direction of a print paper; head drive means for selectively outputting a first signal to cause a stream of ink droplets at a speed suitable for printing and a second signal to cause ink to ooze through each nozzle opening; cleaning means usually positioned in a nonprinting region, but movable in the longitudinal direction of the print head and with respect to a nozzle plate; drive means for moving the cleaning means in the longitudinal direction of the print head; and control means for causing the head drive means to output the second signal in connection with the position of the cleaning means.

In the ink jet printer thus constructed, ink is discharged to such an measure as to moisten the front face of the nozzle plate before the cleaning means is operated. Accordingly, the ink hardened with time on the nozzle plate can easily be dissolved by the ink solvent.

DESCRIPTION OF THE PREFERRED EMBODIMENTS

Preferred embodiments of the present invention will be described with reference to the accompanying drawings.

Figure 1:
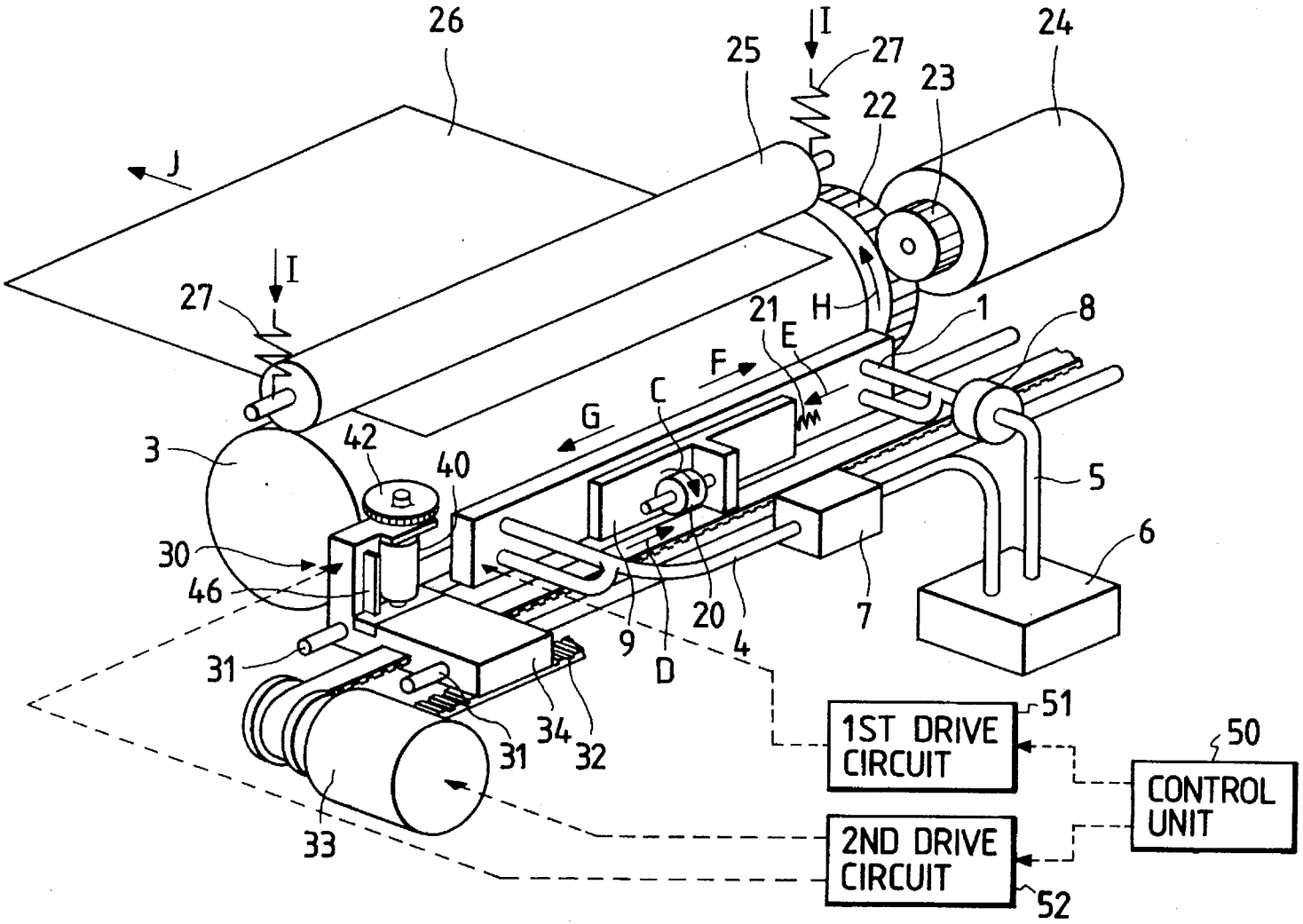
FIG. 1 is a perspective view showing an ink jet printer constructed in accordance with a preferred embodiment of the present invention.

FIG. 1 is a perspective view showing an ink jet printer constructed in accordance with a first preferred embodiment of the present invention. In the figure, reference numeral 1 designates a print head for emitting a jet of ink droplets toward an intermediate recording medium (to be described later). The recording or print head 1, which has an elongated form, includes an array of nozzle openings extending in the width direction of a print paper so as to form a plural number of dots arrayed in a similar fashion by one time emission of ink.

Figure 2:
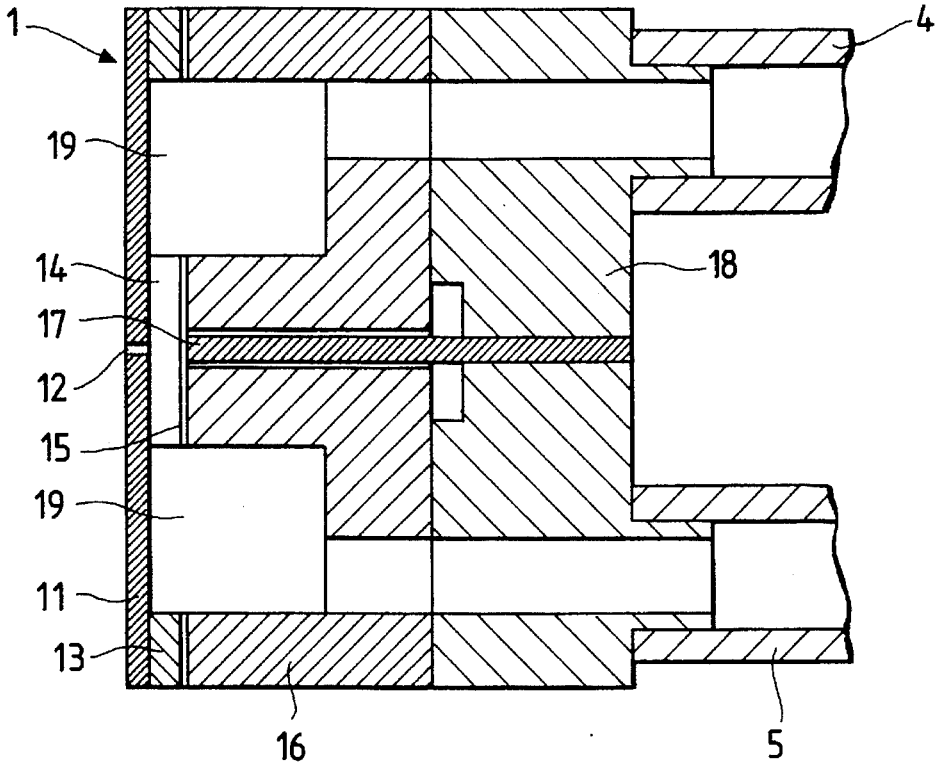
FIG. 2 is a cross-sectional view showing an embodiment of a print head applicable for the ink jet printer of FIG. 1.

In FIG. 2 showing an example of the print head 1, reference numeral 11 designates a nozzle plate. About 2,000 nozzle openings 12 are arrayed linearly or in a zig-zag fashion in the nozzle plate 11. The array of the nozzle openings 12 is long enough to cover the width of a print paper of the maximum size. A plural number (e.g., 400) of nozzle openings 12 are arrayed at the pitch of a plural number (e.g., five) of dots in the row direction. The print head 1 is shifted one dot every turn of an intermediate recording medium 3 so as to complete the image formation of one page when it is turned five times.

Alternatively, the print head 1 may be constructed shorter than the print paper width, having, for example, 100 nozzle openings 12 arrayed at a pitch of five dots. In this case, five cycle motions of the print head 1 completes the formation of an image of length equal to the width of the print head 1. Then, the print head 1 is moved a distance of the entire length of the head, and the above steps are repeated to form an image of the print paper width.

A spacer 13, when mounted on the printer while separating the adjacent nozzle openings 12, defines pressure generating chambers 14 equidistantly arrayed in the horizontal direction. A vibrating plate 15 having a thick part facing each pressure generating chamber 14 is supported by an ink supply member 16. A piezoelectric vibrator 17 is constructed such that a piezoelectric vibrating member is sandwiched by electrodes so that it vibrates in a longitudinal vibration mode by a drive voltage as low as possible. The same number of piezoelectric vibrators 17 as that of the nozzle openings 12 are fixed to a base 18 in a state that the forward ends of the piezoelectric vibrators 17 are in contact with the vibrating plate 15. Each piezoelectric vibrator 17 is operable in two modes. In the first mode, when receiving a drive signal, the piezoelectric vibrator 17 produces energy sufficient to cause ink droplets to strike against the surface of the intermediate recording medium 3 at the speed of 6 m/s or more. In the second mode, it produces such a small energy as to cause ink to only ooze through the nozzle opening 12.

In order to smoothly supply ink to the entire elongated print head 1, the print head 1 is connected to an ink tank 6 by way of ink flow paths 4 and 5, such as tubes. A pump 8 is inserted in the ink flow path 5. A valve 7 is inserted in the ink flow path 4. Through the ink flow circuit, ink is supplied to the print head 1 in a circulating manner. In the print head 1, ink is supplied to the pressure generating chambers 14 through support members 19. Because of the elongated shape of the print head 1, it is mounted on a support member 9. A drive device 20 is provided at one end of the support member 9, while a spring 21 is connected to the other end of the support member 9. When the drive device 20 is turned in the direction of an arrow C, it cooperates with spring 21 to move the support member 9 or the print head 1 a small distance reciprocatively in the directions of arrows G and F (paper width direction). In this way, the print head 1 can emit ink at an appropriate position.

The intermediate recording medium 3, which receives ink droplets from the print head 1, is constructed with a drum of such a length as to be able to receive ink droplets from the print head 1. A layer of silicone rubber is formed on the surface of the drum so that an ink image formed thereon can easily be transferred to a recording paper 26. The intermediate recording medium 3 is coupled with a motor 24 through a power transmission 22 and 23. The intermediate recording medium 3 is rotated in the direction of an arrow H in synchronism with the emission of ink droplets by a drive system including the motor 24 and the power transmission 22 and 23.

Above the intermediate recording medium 3, the pressure roller 25 is supported by bearings such that it may come in contact with and be moved away from the intermediate recording medium 3. At the completion of the formation of an ink image on the intermediate recording medium 3, paired springs 27 and 27 push the pressure roller 25 in the direction of an arrow I so that the pressure roller 25 presses the recording paper 26 against the intermediate recording medium 3.

A cleaning device 30 is mounted on a carriage 34. The carriage 34 is supported by a pair of guides 31, and coupled with a motor 33 by a timing belt 32. In a print mode of the printer, the carriage 34 carrying the cleaning device 30 stays outside a printing region, and in a cleaning mode, it is movable over the entire length of the print head 1.

Figure 3:
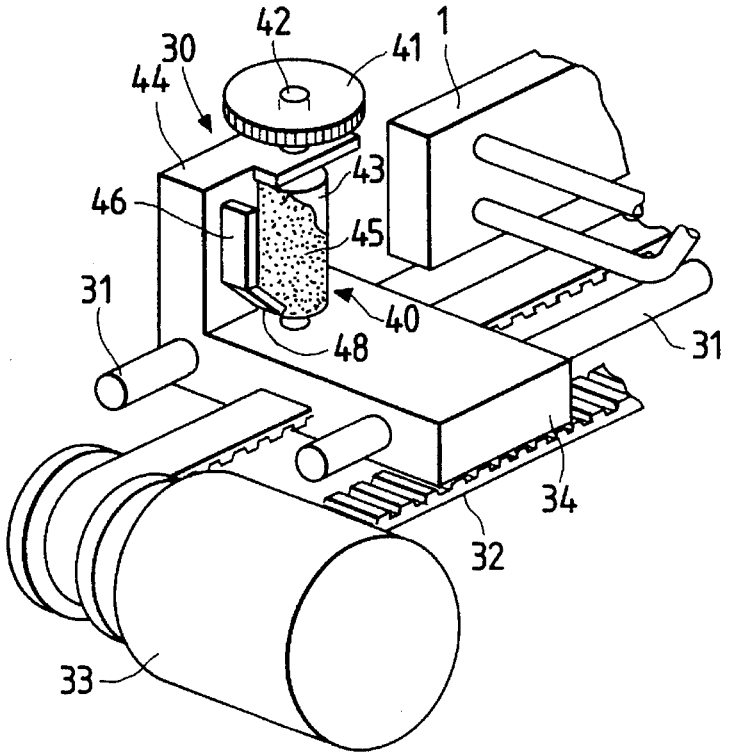
FIG. 3 is an enlarged view showing a cleaning device used in the ink jet printer of FIG. 1.

In FIG. 3 showing the details of the cleaning device used in the ink jet printer, reference numeral 40 designates a first cleaning member whose function is to rub the front face of the nozzle plate 11. In the construction of the first cleaning member 40, a roller 43 made of elastic material, for example, rubber, is formed on a rotary shaft 42 that is connected through a power transmission means 41 to a drive source (not shown). A layer of unwoven cloth 45, which is made of fine fibers and hence free of pieces of thread, is layered on the surface of the roller 43. The rotary shaft 42 of the roller 43 is rotatably supported by a base member 44.

Reference numeral 46 designates a second cleaning member whose function is to wipe the front face of the nozzle plate 11. The second cleaning member 46, which is to be in resilient contact with the front face of the print head 1, is formed with a plate of chloroprene rubber approximately 1 mm thick. The second cleaning member 46 is located adjacent the first cleaning member 40 as viewed in the carriage moving direction. An ink guide member 48 is provided for guiding the ink wiped off by the second cleaning member 46 to the first cleaning member 40. The ink guide member 48 is slantingly disposed such that one end of the ink guide member 48 is located under the lower end of the second cleaning member 46, while the other end thereof is disposed at a location below the lower end of the second cleaning member 46 in a state such that it is brought into contact with the surface of the first cleaning member 40.

Returning to FIG. 1, reference numeral 50 designates a control unit for controlling the cleaning operation of the print head 1. The control unit 50 controls both a first drive circuit 51 and a second drive circuit 52 for moving the cleaning device 30.

Figure 4:
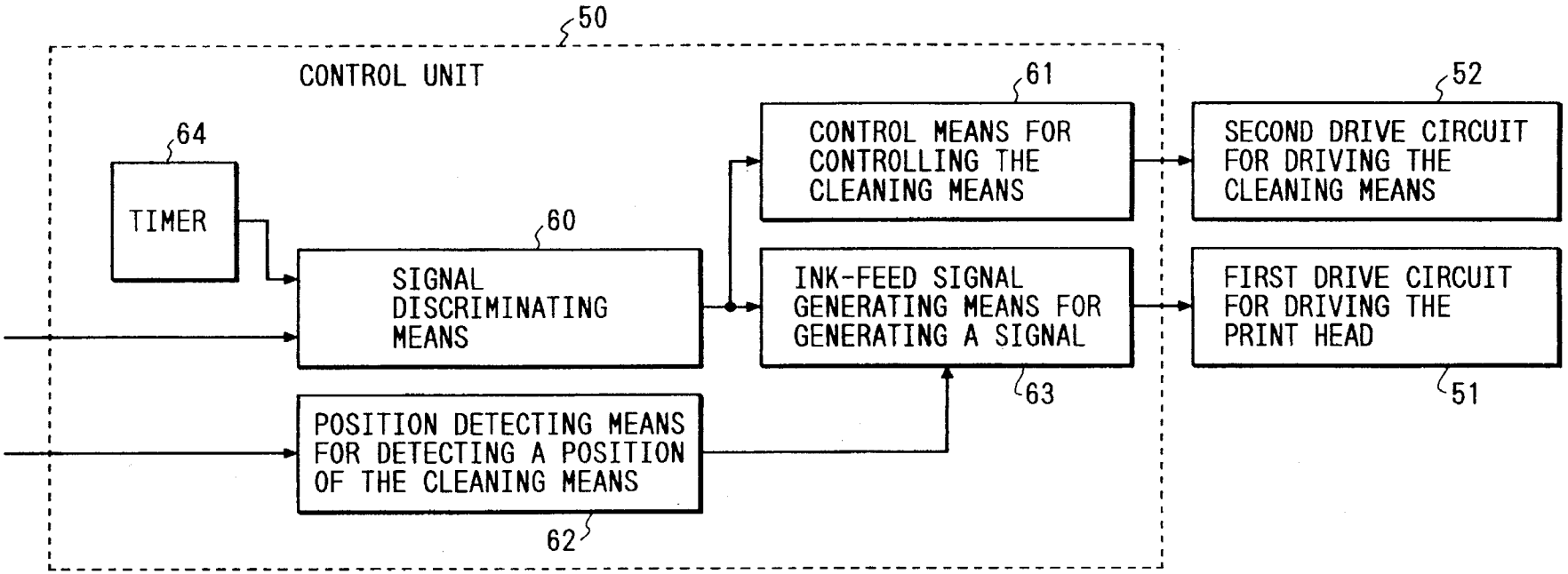
FIG. 4 is a block diagram showing the arrangement of a control unit for the cleaning device in FIG. 1.

As shown in FIG. 4, the control unit 50 is composed of a signal discriminator 60, a cleaning device control unit 61, a position detector 62, an ink-feed signal generator 63, and a timer 64. The signal discriminator 60 discriminates a cleaning instruction contained in a signal received from an external device. The cleaning device control unit 61 controls the rotation and the positioning of the cleaning device 30. The position detector 62 detects the position of the cleaning unit 30, for example, with a counter for counting the number of drive pulses supplied to the motor 33. In connection with the position of the cleaning device 30, the ink-feed signal generator 63 produces a signal for causing the print head 1 to discharge ink with an ink drive energy of such magnitude as to moisten the print head 1, e.g., an energy approximately 1/10 to 1/2 as large as the drive energy for printing. The timer 64 sets the time interval of the cleaning operation.

The operation of the ink jet printer thus constructed will be described. In the ink jet printer, in response to a print instruction from an external device, the motor 33 is operated to retract the cleaning device 30 to a nonprinting region, while at the same time the motor 24 is operated to turn the intermediate recording medium 3 in the direction H. When the rotation of the intermediate recording medium 3 settles to a stationary speed, the first drive circuit 51 produces a drive signal which drives the piezoelectric vibrator 17 designated by print data to cause the discharge of the streams of ink droplets for printing. In response to the drive signal, the print head 1 discharges jets of ink droplets toward the intermediate recording medium 3, thereby forming an image of ink as the mirror image of an image to be printed. When the intermediate recording medium 3 is rotated one turn, a signal is supplied to the drive unit 20. In response to this signal, the print head 1 is moved a predetermined distance in the paper width direction, for example, the direction F. As a result, an image of ink is formed at the position designated by the print data as previously stated.

At the completion of forming the ink image of the print data on the intermediate recording medium 3, a recording paper 26 is supplied from a paper cassette (not shown) to a transfer region, i.e., a region under the pressure roller 25. Then, the pressure roller 25 presses the recording paper 26 against the intermediate recording medium 3 in cooperation with the springs 27. Under this condition, the recording paper 26 is forwarded in synchronism with the movement of the half-dried ink image on the surface of the intermediate recording medium 3. As a result, the ink image is transferred to the recording paper 26 with the assistance of its increased viscosity.

When the printing process as mentioned above has been continued for a period of time, ink spray is attached to the surface of the nozzle plate 11 of the print head 1 and dried. The ink spray attached and dried can possibly change the speed and direction of the streams of ink droplets. Accordingly, the print quality gradually deteriorates.

At an appropriate time before the print quality deterioration starts, in a nonprinting mode of the printer, an operator pushes a button for issuing a cleaning instruction or the timer 64 produces a cleaning instruction signal when a count reaches a preset value. The signal discriminator 60 discriminates the cleaning instruction, and outputs a signal to the control unit 61. The control unit 61 outputs a signal to the second drive circuit 52, which then causes the motor 33 to turn. With the turning of the motor, the cleaning device 30 is moved from the nonprinting region to the printing region. At the same time, the second drive unit drives the first cleaning member 40 to turn.

The output signal of the signal discriminator 60 is also input to the ink-feed signal generator 63. The ink-feed signal generator 63 receives a signal indicative of the present position of the cleaning device 30 from the position detector 62, and selects the nozzle opening 12 confronted by the first cleaning member 40 and several nozzle openings 12 preceding and subsequent to the former opening. Then, the ink-feed signal generator 63 drives the first drive circuit 51 to output a drive signal to the piezoelectric vibrators 17 corresponding to the selected nozzle openings 12 through which ink is to be forcibly discharged.

Figure 5A:
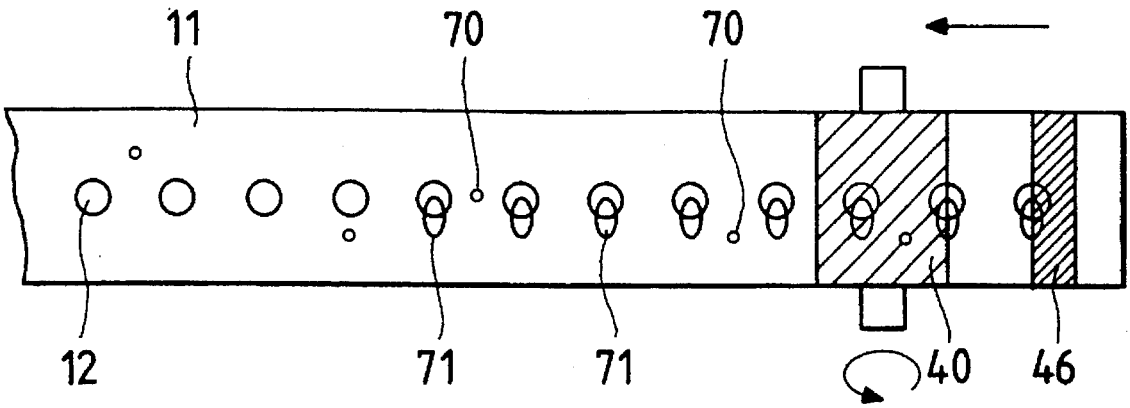
FIGS. 5(*a*), 5(*b*), and 5(*c*) are diagrams showing the operation of the cleaning device.
Figure 5B:
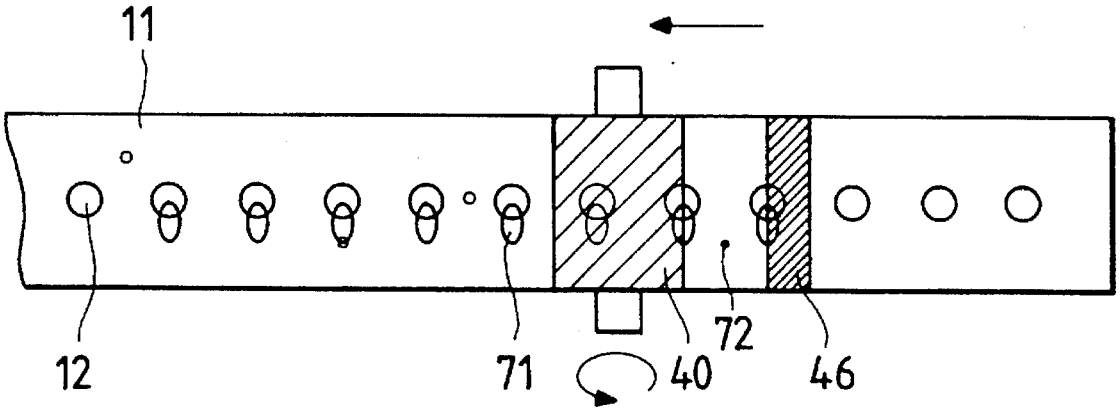
Figure 5C:
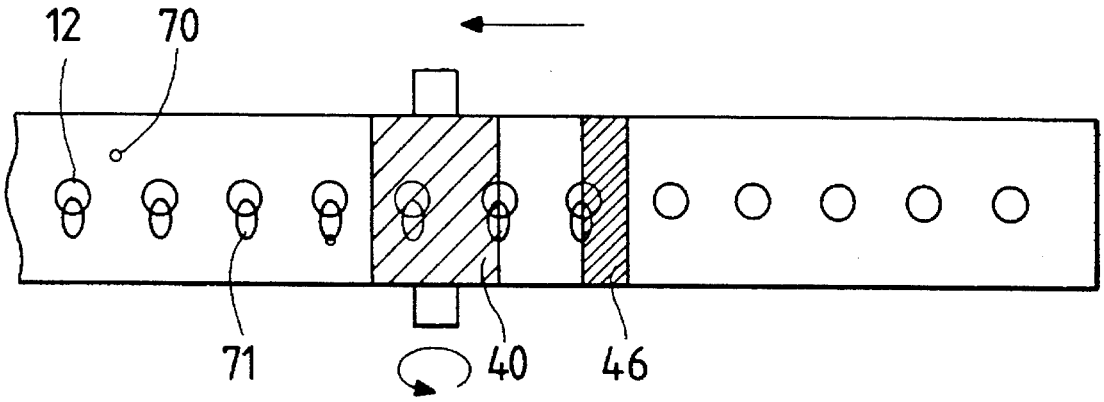

Dried ink spots 70 located forward of the first cleaning member 40 (on the left side of the first cleaning member 40 in FIGS. 5(*a*), 5(*b*), and 5(*c*) are moistened and softened by ink droplets 71 discharged from the nozzle openings 12. The first cleaning member 40 rubs the moistened ink spots 70 off the front face of the nozzle plate 11 using as a lubricant ink droplets 71 exuding through the nozzle openings 12 (FIG. 5(*a*)). The ink thus rubbed off is wiped away by the layer of unwoven cloth 45 of the first cleaning member 40 (FIG. 5(*b*)).

In the region of the front face of the nozzle plate 11 after it has experienced the ink rubbing-off operation by the first cleaning member 40, the nozzle openings 12 located forward of the second cleaning member 46 also discharge ink. Accordingly, the region where rubbing has been completed is further moistened by the ink. In this state, if the cleaning device 30 is further moved forward, the second cleaning member 46 now passes the rubbing-off completed region to wipe away ink 72 left after the cleaning by the first cleaning member 40 and the ink discharged from the nozzle openings 12 (FIG. 5(*c*)). In this way, ink left after the cleaning by the first cleaning member 40 and ink residue attached again are wiped away by the second cleaning member 46. The ink and the ink residue thus wiped off drop into the ink guide member 48 and flow to the first cleaning member 40. The ink is then absorbed by the unwoven cloth 45 of the first cleaning member 40, and used to moisten the front face of the nozzle plate 11. The use of the ink thus collected eliminates an additional supply of fresh ink for cleaning.

When the cleaning device 30 moves along the nozzle plate 11 and reaches the other end of the nozzle plate 11, the control unit 61 detects this and rotates the motor 33 in the reverse direction and moves the cleaning device 30 to the nonprinting region. This cleaning operation is repeated until the print head 1 regains the normal ink discharge function. When a preliminary cleaning operation is carried out because of small amounts of the ink spray and residue on the front face of the nozzle plate 11, the first cleaning member 40 is rotated at a reduced speed.

In this embodiment, the ink is continuously discharged from the nozzle openings 12 located in the cleaning region. If required, it may be discharged intermittently.

A cleaning device including a first cleaning member and a second cleaning member was used. In the first cleaning member, a layer of unwoven cloth covered the surface of a rubber roller 16 mm in diameter. The first cleaning member was rotated at a speed of 120 rpm. The second cleaning member was a rubber plate 1 mm thick. The front face of a nozzle plate of a print head was coated with a predetermined amount of ink. Cleaning operations were carried out while exuding ink through the nozzle openings. The same operations were also carried out while not flowing ink therethrough, that is, in the conventional manner. The number of cleaning operations repeated until the normal print function of the print head was restored was measured for different times elapsing after the nozzle plate was coated with ink and left to stand. The results of these measurements were as shown in FIG. 6.

Figure 6:
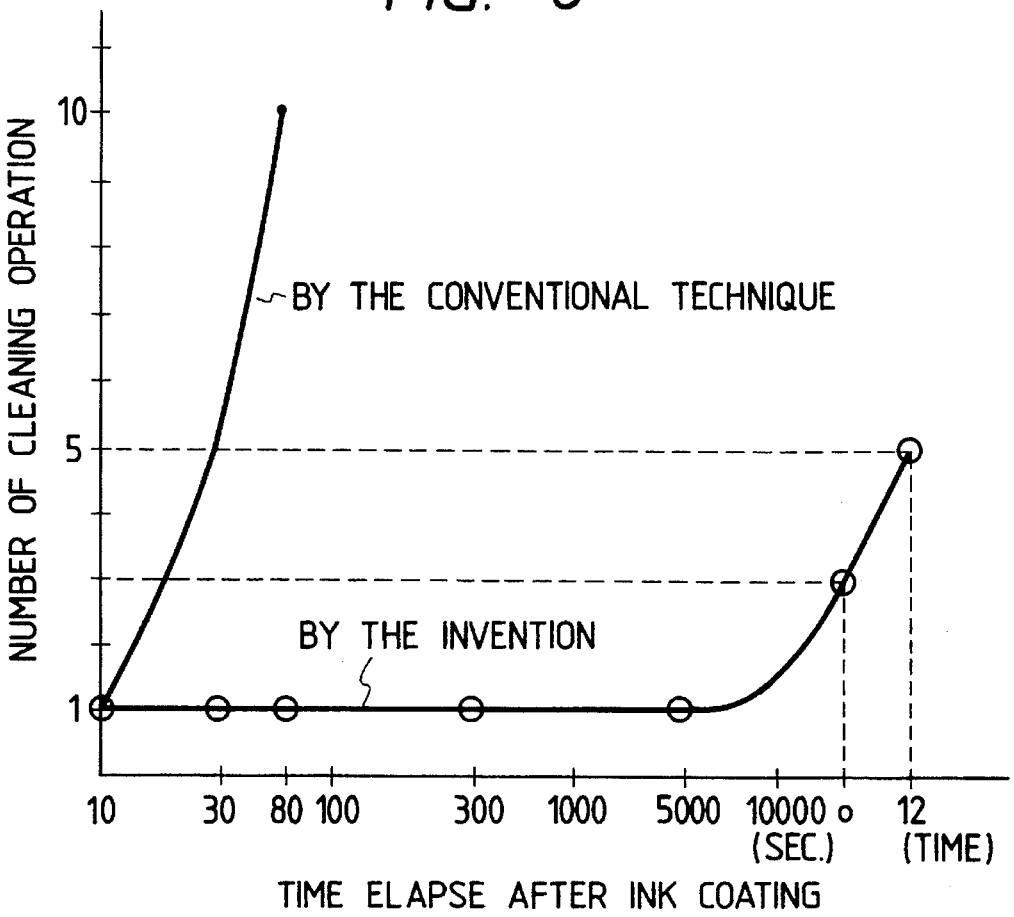
FIG. 6 is a graph comparatively showing the number of cleaning operations vs. the time elapsed after the application of ink for coating.

As seen from FIG. 6, when the cleaning operation of the invention was used wherein cleaning was carried out in a state where the nozzle openings and the adjacent areas are moistened with ink oozing through the nozzle openings, only one cleaning operation was required until the printing capability of the print head was restored to normal when approximately 5,000 seconds (1.4 hour) elapsed after ink was adhered to the nozzle plate. Even after 12 hours elapsed, only about five cleaning operations were required until the print head regained its normal print capability.

In the conventional cleaning technique wherein the nozzle plate is not moistened with ink, five cleaning operations were required for a lapse of 30 seconds, and ten cleaning operations, for a lapse of 60 seconds.

From these test results, it is seen that when the cleaning operation of the invention is applied to an ink jet printer using ink of the type which tends to harden quickly and has a high viscosity, the normal ink discharge capability of the print head can be restored remarkably quickly.

In the embodiment described above, the first and second cleaning members are constantly brought into contact with the print head. Alternatively, the cleaning members may be selectively brought into contact with the print head. In this case, a drive unit, such as a solenoid, is coupled with the support for the cleaning members so that it selectively moves the first and second cleaning members toward and from the face of the print head. Thus, the cleaning device operates selectively in a wiping mode and a rubbing mode, thereby securing further complete cleaning.

Figure 7:
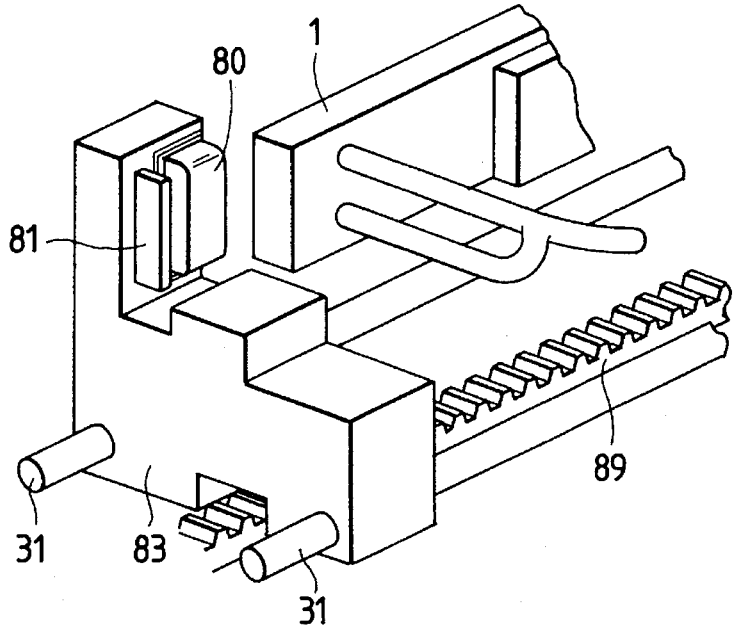
FIG. 7 is a perspective view showing another cleaning device according to the present invention.

FIG. 7 is a perspective view showing another cleaning device according to the present invention. In the figure, reference numeral 80 designates a first cleaning member, and numeral 81 represents a second cleaning member. These first and second cleaning members 80 and 81 are supported by a carriage 83. The carriage 83 is guided by a guide member 31, and 31 by means of a rack-pinion mechanism, in the direction in which the nozzle openings are arrayed. A pinion (not shown) in the carriage 83 is in mesh with a rack 89 disposed also in the direction of the nozzle opening array.

Figure 8:
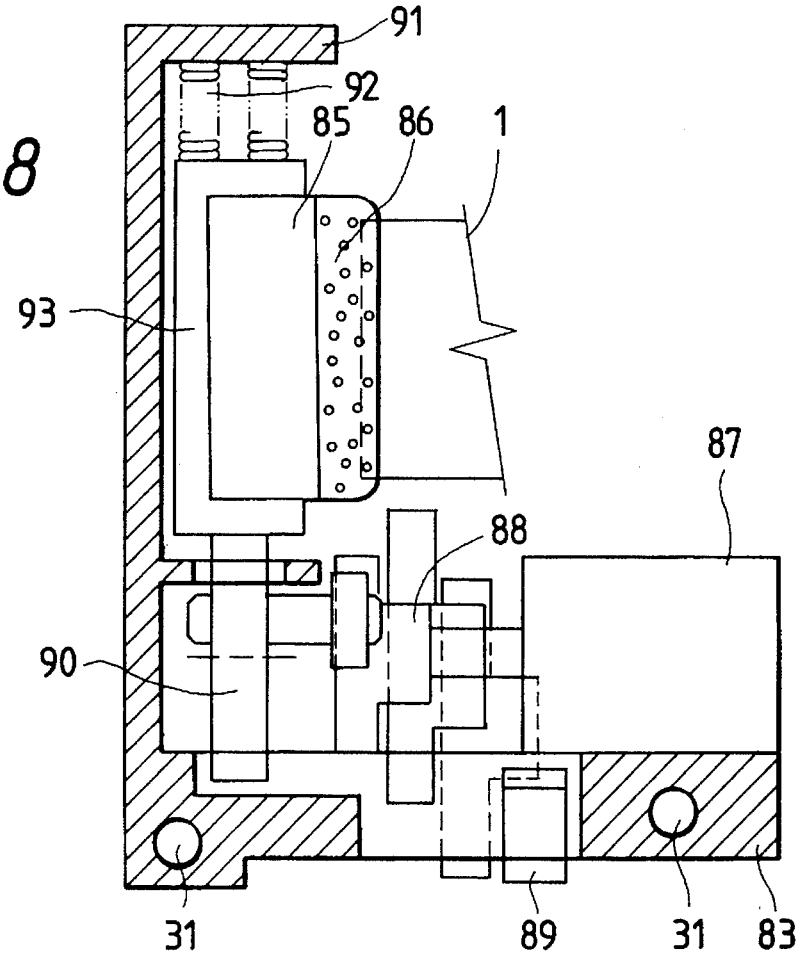
FIG. 8 is a sectional view showing the details of the cleaning device of FIG. 7.

In the first cleaning member 80, as shown in FIG. 8, a pad 86 made of a water absorbing material not generating pieces of thread, such as unwoven cloth, is placed on the surface of the parallelepiped base 85 made of elastic material, such as rubber. The member body proper is fastened to a drive shaft 90 engaging an eccentric cam 88, which is coupled with a rotary drive unit 87. The member body proper is mounted on a base 93, which is constantly pressed downward by springs 92, which are inserted between the other end of the member body proper and a frame 91.

In operation, when the rotary drive unit 87 is rotated in a state such that the cleaning device is in contact with the print head 1, the eccentric cam 88 moves the drive shaft 90 in the direction vertical to the array of the nozzle openings 12 (vertically in the drawing). Consequently, the ink layer attached adhering the surface of the print head 1 is rubbed with the pad 86. When the cleaning device moves in the longitudinal direction of the print head 1, the ink adhering to the print head 1 is wiped off with the second cleaning member 81.

Figure 9:
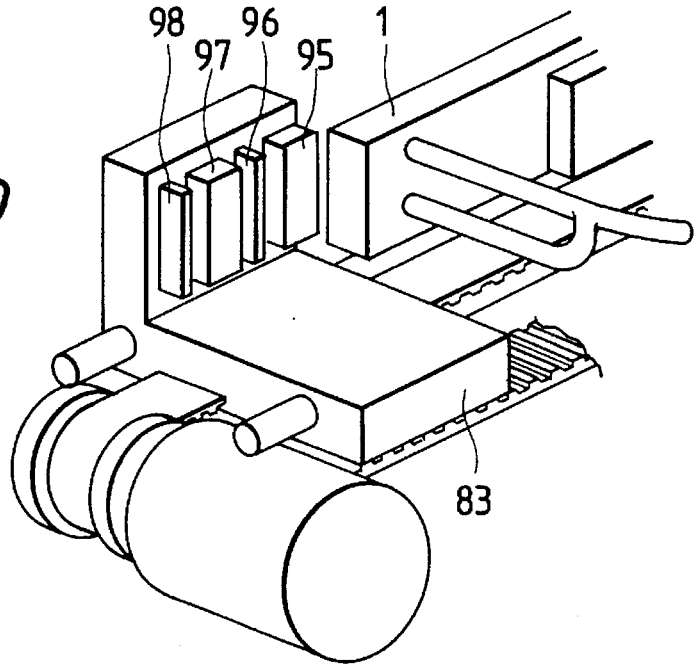
FIG. 9 is a perspective view showing yet another cleaning device according to the present invention.

In the cleaning device as described above, a pair of cleaning members, the first and second cleaning members, are mounted on the carriage 83. In a cleaning device shown in FIG. 9, two pairs of first and second cleaning members 95 and 96, and 97 and 98 are disposed side by side in their direction of movement. The use of two pairs of cleaning members provides further improved cleaning performances.

Figure 10A:
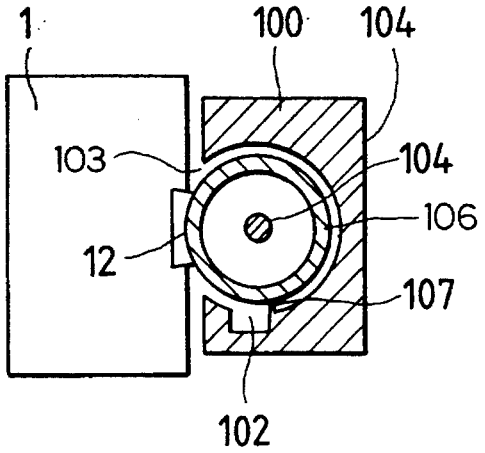
FIGS. 10(*a*) and 10(*b*) are sectional views showing another type of the first cleaning member of the cleaning device in the ink jet printer of the invention.
Figure 10B:
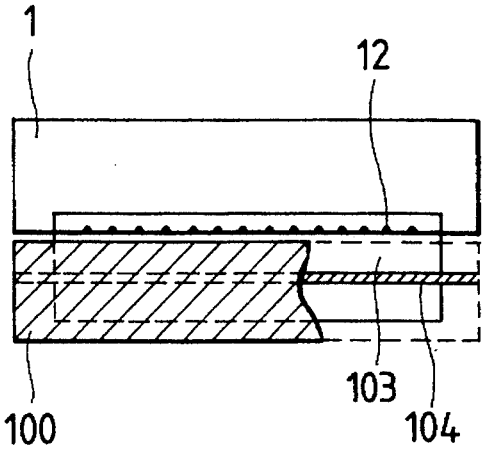
Figure 11A:
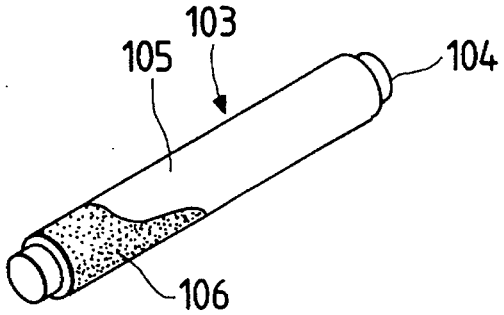
FIGS. 11(*a*) to 11(*d*) are perspective views showing examples of cleaning units applicable for the first cleaning member.
Figure 11B:
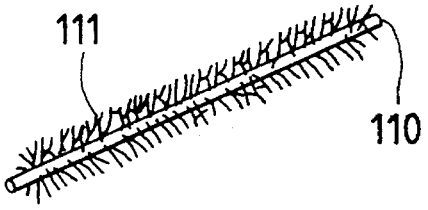
Figure 11C:
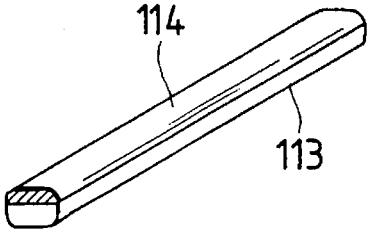
Figure 11D:
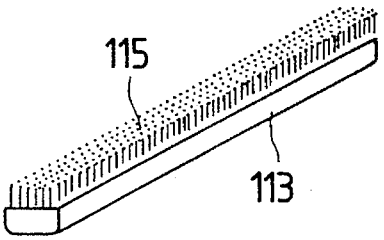

FIGS. 10(*a*) and 10(*b*) are sectional views showing another type of the first cleaning member of the cleaning device with a rubbing function, which can be used in the ink jet printer of the invention. As shown, a main body case 100 extends along the array of the nozzle openings 12 of the print head 1. The body case 100 has an elongated opening in the side thereof facing the arrayed nozzle openings 12. Through the elongated opening, a cleaning unit 103 (to be described later) is exposed to the outside. A cavity 102 for receiving ink residue is formed in the bottom of the main body case.

The cleaning unit, designated by reference numeral 103, is constructed such that, as shown in FIG. 11(*a*), a layer 106 formed of an unwoven cloth, for example, is provided on the surface of a roller 105 made of elastic material, and the roller 105 is fastened to a rotary shaft 104, which is driven by an external device. A blade 107 resiliently contacts the surface of the cleaning unit 103 so that ink and ink residue adhering to the surface of the cleaning unit 103 are scraped off the surface.

In operation, the cleaning unit 103 is rotated by means of a drive unit (not shown)while exuding ink droplets through the nozzle openings 12. The area around the nozzle openings is rubbed with the unwoven cloth layer 106, thereby scraping the hardened ink from the area. The ink residue scrapped off through the process of cleaning drops into the cavity 102, and is thus confined within the main body case 100.

The cleaning unit 103 may use a brush as shown in FIG. 11(*b*). As shown, the brush, long and circular in cross section, includes resilient bristles 111 fastened to a rotary shaft 110. The resilient bristles 111 are made of synthetic resin or a natural material which will not damage the nozzle plate 11.

Cleaning units constructed as shown in FIGS. 11(*c*) and 11(*d*) are suitable for the cleaning unit of the type in which the shaft is reciprocatively turned. In the case of FIG. 11(*c*), a rubbing member 114 is mounted on a base plate 113, which is reciprocatively turned by an external device. The rubbing member 114 is constructed such that the surface of a long resilient member fixed to the base plate 113 is covered with unwoven cloth. In the case of FIG. 11(*d*), resilient bristles 115 are planted in the base plate 113.

Figure 12:
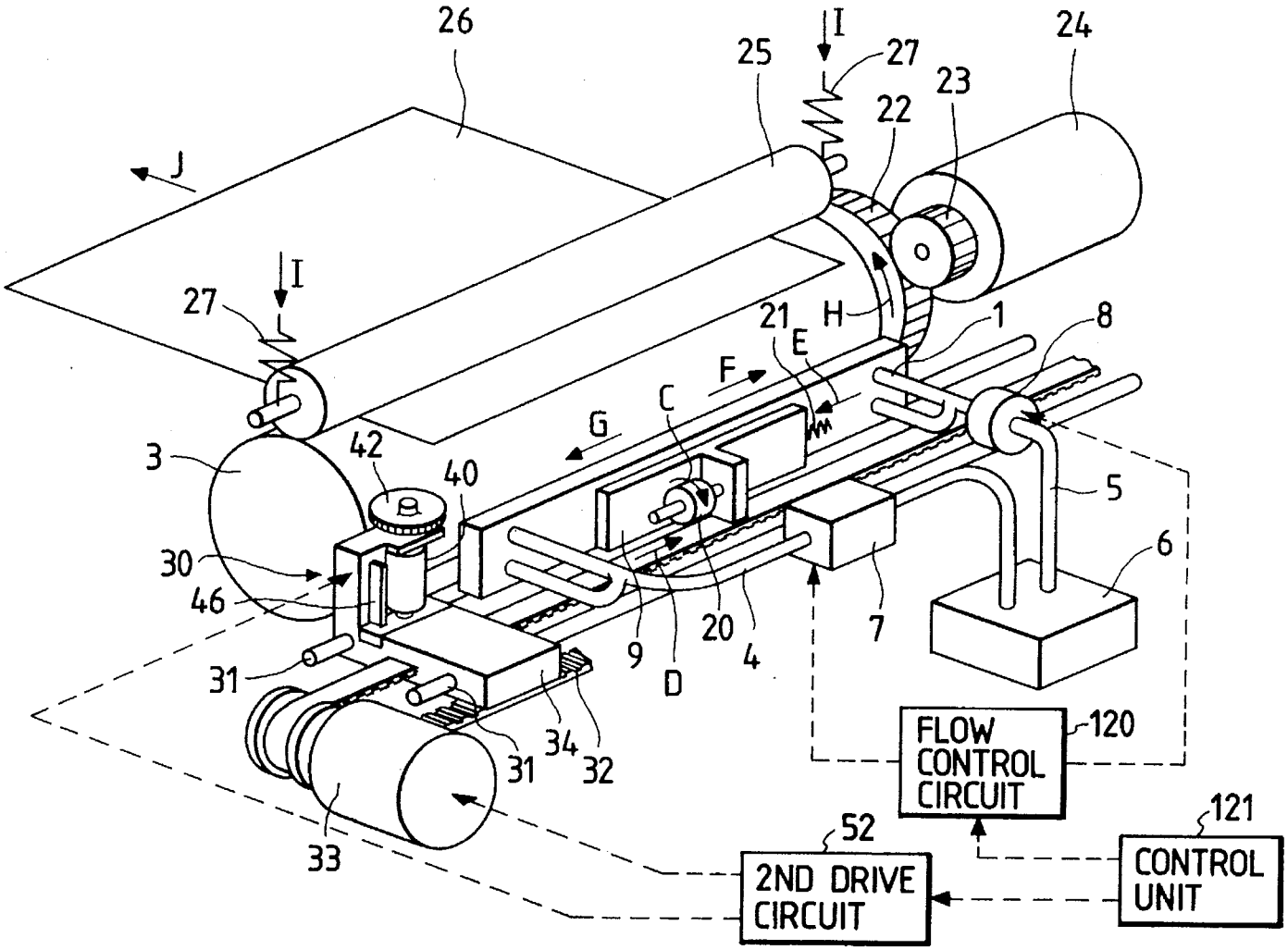
FIG. 12 is a perspective view showing an ink jet printer according to another embodiment of the present invention.

In the above-mentioned embodiment, ink droplets for cleaning are supplied as in the ink discharging operation in the print mode. In another ink jet printer shown in FIG. 12, the ink jet printer has the ink flow control circuit 120, which controls the operation of the pump 8, for supplying ink from the ink tank 6 to the print head 1 at a slightly higher speed, and/or the operation of the valve 7. In the operation of the ink jet printer including the ink flow control circuit 120, the ink pressure within the print head 1 is increased by a signal from a control unit 121 similar to that of the previous case. Under this condition, the ink is discharged through all of the nozzle openings 12 immediately before the cleaning operation starts, and then the cleaning operation by the second drive circuit 52 starts.

In the above-described embodiments, ink is used for moistening the nozzle plate 11. The ink may be replaced with a liquid which will not harden the ink when it is applied through the nozzle opening 12 to the print head 1. An example of such a liquid is ink solvent. In this case, the cleaning operation by the first and second cleaning members is carried out after the nozzle plate 11 is coated with such a liquid using a suitable coating device.

In the ink jet printers described above, ink droplets discharged from the print head are received by the intermediate recording medium, and then the image formed by the ink droplets is transferred from the intermediate recording medium to a print paper. It is evident though that the present invention is applicable for the ink jet printer of the type in which an image is directly formed on the print paper by ink droplets discharged from the print head.

As described above, the ink jet printer of the present invention includes a print head including a plural number of pressure generating chambers communicating with nozzle openings and pressure generating elements each for varying a pressure to within a corresponding pressure generating chamber to jet from the respective nozzle opening a stream of ink droplets, the pressure generating chambers and the pressure generating elements being arrayed in the width direction of a print paper; head drive means for selectively outputting a first signal to cause a stream of ink droplets at a speed suitable for print and a second signal to cause ink to ooze through each nozzle opening; cleaning means being usually positioned in a nonprinting region, but movable in the longitudinal direction of the print head and with respect to a nozzle plate; drive means for moving the cleaning means in the longitudinal direction of the print head; and a control unit for causing the head drive means to output the second signal in connection with a position of the cleaning means. With such a construction, dried ink adhering to the print head can be completely removed without any special detergent, even if the ink of a type having an increased viscosity and which is easily hardened, which is used where print quality improvement is required.

What is claimed is:

1. An ink jet printer, comprising:

a print head including a nozzle plate, a plurality of pressure generating chambers respectively communicating with an array of nozzle openings, and a plurality of pressure generating elements each for varying a pressure within a corresponding one of said pressure generating chambers to jet a stream of ink droplets from a respective one of said nozzle openings, wherein said pressure generating chambers and said pressure generating elements are arrayed in a width direction of a print paper;

head drive means for selectively outputting a first signal to said pressure generating elements to cause a stream of ink droplets to be ejected from said nozzle openings at a speed suitable for print and a second signal to cause ink to ooze through said nozzle openings;

cleaning means for cleaning said nozzle plate, wherein said cleaning means is disposed in a nonprinting region during normal printing operations of said printer, is movable in a direction of said array of nozzle openings and with respect to said nozzle plate, and intersects a horizontal plane substantially defined by said stream of ink droplets sprayed during said normal printing operations;

drive means for moving said cleaning means in said longitudinal direction of said print head to wipe ink from said nozzle plate; and control means for causing said head drive means to output said second signal when said cleaning means is wiping ink from said nozzle plate, wherein said cleaning means comprises a first cleaning member for performing a rubbing operation and a second cleaning member for performing a wiping operation and wherein said rubbing operation and said wiping operation are simultaneously performed on said nozzle plate.

2. The ink jet printer according to claim 1, further comprising an ink guide member, said first cleaning member and said second cleaning member being connected to each other by said ink guide member, said ink guide member guiding ink wiped off by said second cleaning member to said first cleaning member.

3. An ink jet printer, comprising:

a print head including a nozzle plate, a plurality of pressure generating chambers communicating with respective nozzle openings, and a plurality of pressure generating elements each for varying a pressure within a corresponding one of said pressure generating chambers to jet a stream of ink droplets from a respective one of said nozzle openings, wherein said pressure generating chambers and said pressure generating elements are arrayed in a width direction of a print paper;

pump means for forcibly supplying ink to said print head;

head drive means for selectively outputting a signal to said pressure generating elements to cause a stream of ink droplets to be ejected from said nozzle openings at a speed suitable for printing;

cleaning means for cleaning said nozzle plate, wherein said cleaning means is disposed in a nonprinting region during normal printing operations of said printer, is movable in a longitudinal direction of said print head and with respect to said nozzle plate, and intersects a horizontal plane substantially defined by said stream of ink droplets sprayed during said normal printing operations;

drive means for moving said cleaning means in said longitudinal direction of said print head perform a cleaning operation to wipe ink from said nozzle plate; and control means for causing said pump means to ooze ink through the nozzle opening immediately before a cleaning operation, wherein said cleaning means comprises a first cleaning member for performing a rubbing operation and a second cleaning member for performing a wiping operation and wherein said rubbing operation and said wiping operation are simultaneously performed on said nozzle plate.

4. The ink jet printer according to claim 3, further comprising an ink guide member, said first cleaning member and said second cleaning member being connected to each other by said ink guide member, said ink guide member guiding ink wiped off by said second cleaning member to said first cleaning member.

5. An ink jet printer comprising:

a print head including a nozzle plate, a plurality of pressure generating chambers respectively communicating with an array of nozzle openings, and a plurality of pressure generating elements each for varying a pressure within a corresponding one of said pressure generating chambers to jet a stream of ink droplets from a respective one of said nozzle openings, wherein said pressure generating chambers and said pressure generating elements are arrayed in a width direction of a print paper;

head drive means for selectively outputting a first signal to said pressure generating elements to cause a stream of ink droplets to be ejected from said nozzle openings at a speed suitable for print and a second signal to cause ink to ooze through said nozzle openings;

cleaning means for cleaning said nozzle plate, wherein said cleaning means is disposed in a nonprinting region during normal printing operations of said printer, is movable in a direction of said array of nozzle openings and with respect to said nozzle plate, intersects a horizontal plane substantially defined by said stream of ink droplets sprayed during said normal printing operations, and comprises a first cleaning member for performing a rubbing operation and a second cleaning member for performing a wiping operation;

drive means for moving said cleaning means in said longitudinal direction of said print head to wipe ink from said nozzle plate;

control means for causing said head drive means to output said second signal when said cleaning means is wiping ink from said nozzle plate; and an ink guide member, wherein said first cleaning member and said second cleaning member are connected to each other by said ink guide member and wherein said ink guide member guides ink wiped off by said second cleaning member to said first cleaning member.

6. An ink jet printer comprising:

a print head including a nozzle plate, a plurality of pressure generating chambers communicating with respective nozzle openings, and a plurality of pressure generating elements each for varying a pressure within a corresponding one of said pressure generating chambers to jet a stream of ink droplets from a respective one of said nozzle openings, wherein said pressure generating chambers and said pressure generating elements are arrayed in a width direction of a print paper;

pump means for forcibly supplying ink to said print head;

head drive means for selectively outputting a signal to said pressure generating elements to cause a stream of ink droplets to be ejected from said nozzle openings at a speed suitable for printing;

cleaning means for cleaning said nozzle plate, wherein said cleaning means is disposed in a nonprinting region during normal printing operations of said printer, is movable in a longitudinal direction of said print head and with respect to said nozzle plate, intersects a horizontal plane substantially defined by said stream of ink droplets sprayed during said normal printing operations, and comprises a first cleaning member for performing a rubbing operation and a second cleaning member for performing a wiping operation;

drive means for moving said cleaning means in said longitudinal direction of said print head perform a cleaning operation to wipe ink from said nozzle plate;

control means for causing said pump means to ooze ink through the nozzle opening immediately before a cleaning operation; and an ink guide member, wherein said first cleaning member and said second cleaning member are connected to each other by said ink guide member and wherein said ink guide member guides ink wiped off by said second cleaning member to said first cleaning member.

* * * * *